US005644806A

United States Patent [19]

Mariol et al.

[11] Patent Number: 5,644,806

[45] Date of Patent: Jul. 8, 1997

[54] PLAYYARD SYSTEM WITH A HANDLE AND WHEELS

[75] Inventors: John V. Mariol, Cincinnati; Christopher Arens, Troy, both of Ohio

[73] Assignee: James F. Mariol, Wyoming, Ohio

[21] Appl. No.: 556,190

[22] Filed: Nov. 9, 1995

[51] Int. Cl.[6] ..... A47D 7/00

[52] U.S. Cl. ..... 5/99.1; 5/93.1; 5/93.2; 5/94; 5/95

[58] Field of Search ..... 5/93.1, 93.2, 94, 5/95, 99.1; 256/25

[56] References Cited

U.S. PATENT DOCUMENTS

| | | | |
|---|---|---|---|
| 2,377,024 | 5/1945 | Millek | 5/93.1 |
| 2,781,526 | 2/1957 | Zimmerman | 5/93.1 |
| 2,958,084 | 11/1960 | Kenney | 5/98.1 |
| 3,064,277 | 11/1962 | Gill | 5/90.1 |
| 4,811,437 | 3/1989 | Dillner et al. | 5/93.1 |
| 4,837,875 | 6/1989 | Shamie et al. | 5/99.1 |
| 5,291,976 | 3/1994 | Ku | 196/18 |

*Primary Examiner*—Steven N. Meyers
*Assistant Examiner*—Fredrick Conley

[57] ABSTRACT

A playyard system with a handle and wheels comprising a floor separable from a playyard and formed of a plurality of similarly shaped rigid rectangular segments. The floor is adapted to be placed around a collapsed playyard to form a generally rectilinear configuration with an upper end and a lower end. A handle is secured to one of the segments of the floor adjacent to the upper end. The handle includes a gripping portion at the upper extent and a generally rigid intermediate wire formed with parallel vertical extents and an enlarged lower extent. The handle also has associated therewith apertured brackets secured to the floor for allowing for the sliding of the wire within the brackets to lower the handle toward the floor when in the stowed orientation and to raise the handle from the floor when in the elevated orientation for transportation.

4 Claims, 5 Drawing Sheets

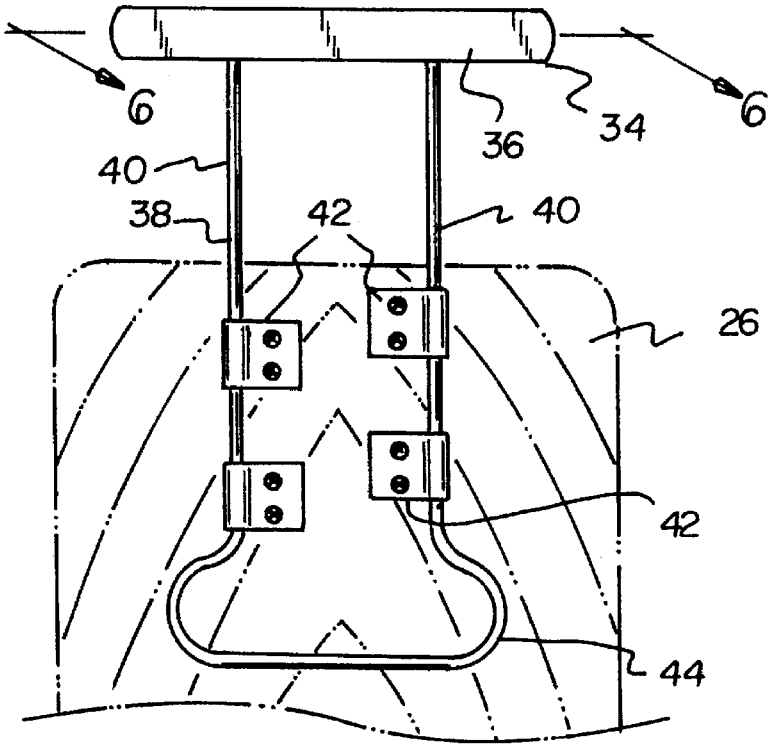
FIG 5
FIG 6
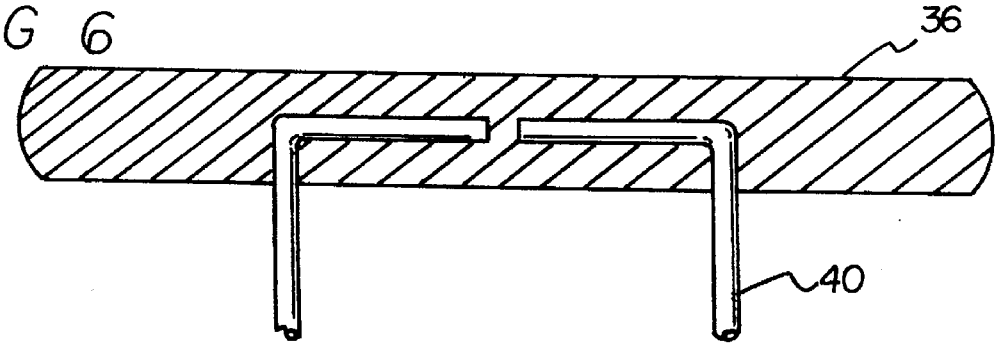
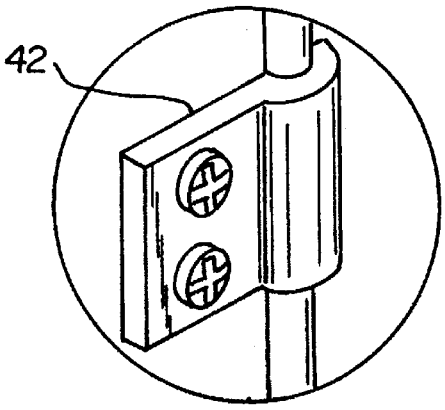
FIG 7
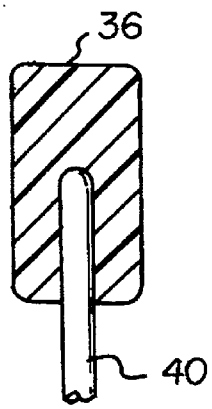
FIG 8

PLAYYARD SYSTEM WITH A HANDLE AND WHEELS

BACKGROUND OF THE INVENTION

1. Field of the Invention

The present invention relates to a playyard system with a handle and wheels and more particularly pertains to facilitating the easy movement of a collapsed playyard.

2. Description of the Prior Art

The use of wheeled articles, containers and related devices of various designs and configurations is known in the prior art. More specifically, wheeled articles, containers and related devices of various designs and configurations heretofore devised and utilized for the purpose of transporting relatively heavy articles through the use of wheels and handles by various methods and apparatuses are known to consist basically of familiar, expected and obvious structural configurations, notwithstanding the myriad of designs encompassed by the crowded prior art which have been developed.

By way of example, the prior art discloses in U.S. Pat. No. 4,588,055 to Chen discloses a device for towing luggage. U.S. Pat. No. 4,792,025 to Thomas discloses a caddy luggage. U.S. Pat. No. 5,335,759 to Yeh discloses an extendible handle assembly for wheeled luggage. U.S. Pat. No. 2,011,880 to Stein, unassigned on its face, discloses a disappearing handle.

In this respect, the playyard system with a handle and wheels according to the present invention substantially departs from the conventional concepts and designs of the prior art, and in so doing provides an apparatus primarily developed for the purpose of facilitating the easy movement of a collapsed playyard.

Therefore, it can be appreciated that there exists a continuing need for new and improved playyard system with a handle and wheels which can be used for facilitating the easy movement of a collapsed playyard. In this regard, the present invention substantially fulfills this need.

SUMMARY OF THE INVENTION

In view of the disadvantages inherent in the known types of wheeled devices, containers and related devices of various designs and configurations now present in the prior art, the present invention provides an improved playyard system with a handle and wheels. As such, the general purpose of the present invention, which will be described subsequently in greater detail, is to provide a new and improved playyard system with a handle and wheels which has all the advantages of the prior art and none of the disadvantages.

To attain this, the present invention essentially comprises a new and improved playyard system with a handle and wheels for facilitating transportation of the playyard comprising, in combination, a playyard having a fabric support for receiving a child. The playyard has a frame to maintain the support in a generally rectilinear configuration for operation and use. The frame is also adapted to collapse to a reduced size in a generally rectilinear configuration for transportation and storage. The frame has four corners with fixed legs at two corners and two rotatable wheels at the other corners. A separable floor is formed of four similarly shaped rigid rectangular segments positionable on the lower surface of the container during operation and use. The floor is adapted to be removed from the container and placed around the playyard when in a collapsed orientation to form a generally rectilinear configuration with an upper end and a lower end and with the legs and wheels of the frame extending from the lower end. A handle is secured to one of the segments of the floor adjacent to the upper end. The handle includes a generally horizontal gripping portion at the upper extent and a generally rigid intermediate wire formed with parallel vertical extents and an enlarged lower extent. The handle also has associated therewith two pair of apertured brackets secured to the floor for allowing for the sliding of the wire within the brackets to lower the handle toward the floor when in the stowed orientation and to raise the handle from the floor when in the elevated orientation for transportation whereby a user may grasp the elevated handle, pivot the playyard, floor and wheels to raise the legs and then pull the playyard and floor while the wheels rotate. A fabric container has a generally rectilinear configuration for receiving the playyard and floor and handle with an opened lower end for the passage of the legs and wheels therefrom and with a closed upper end with a slit adjacent one edge overlying the handle for the passage of the handle therethrough.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved playyard system with a handle and wheels which has all the advantages of the prior art devices and none of the disadvantages.

It is another object of the present invention to transport a collapsed playyard system with a handle and wheels in a more convenient manner.

It is a further object of the present invention to lessen the burden of a child care provider by facilitating the movement of a playyard.

An even further object of the present invention is to provide a new and improved playyard system with a handle and wheels which is susceptible of a low cost of manufacture with regard to both materials and labor, and which accordingly is then susceptible of low prices of sale to the consuming public, thereby making such wheeled devices, containers and related devices of various designs and configurations economically available to the buying public.

Still another object of the present invention is to facilitate the handling of a playyard.

Lastly, it is an object of the present invention to provide a new and improved playyard system with a handle and wheels comprising a floor separable from a playyard and formed of a plurality of similarly shaped rigid rectangular segments. The floor is adapted to be placed around a collapsed playyard to form a generally rectilinear configuration with an upper end and a lower end. A handle is secured to one of the segments of the floor adjacent to the upper end. The handle includes a gripping portion at the upper extent and a generally rigid intermediate wire formed with parallel vertical extents and an enlarged lower extent. The handle also has associated therewith apertured brackets secured to the floor for allowing for the sliding of the wire within the brackets to lower the handle toward the floor when in the stowed orientation and to raise the handle from the floor when in the elevated orientation for transportation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a front elevational view similar to FIG. 4 but with the handle removed.

FIG. 6 is a cross sectional view taken through line 6—6 of FIG. 5.

FIG. 7 is an enlarged perspective illustration of the bracket taken at circle 7 of FIG. 2.

FIG. 6 is a cross sectional view taken through line 8—8 of FIG. 4.

Similar reference characters refer to similar parts throughout the several views of the drawings.

DESCRIPTION OF THE PREFERRED EMBODIMENT

Figure 1:
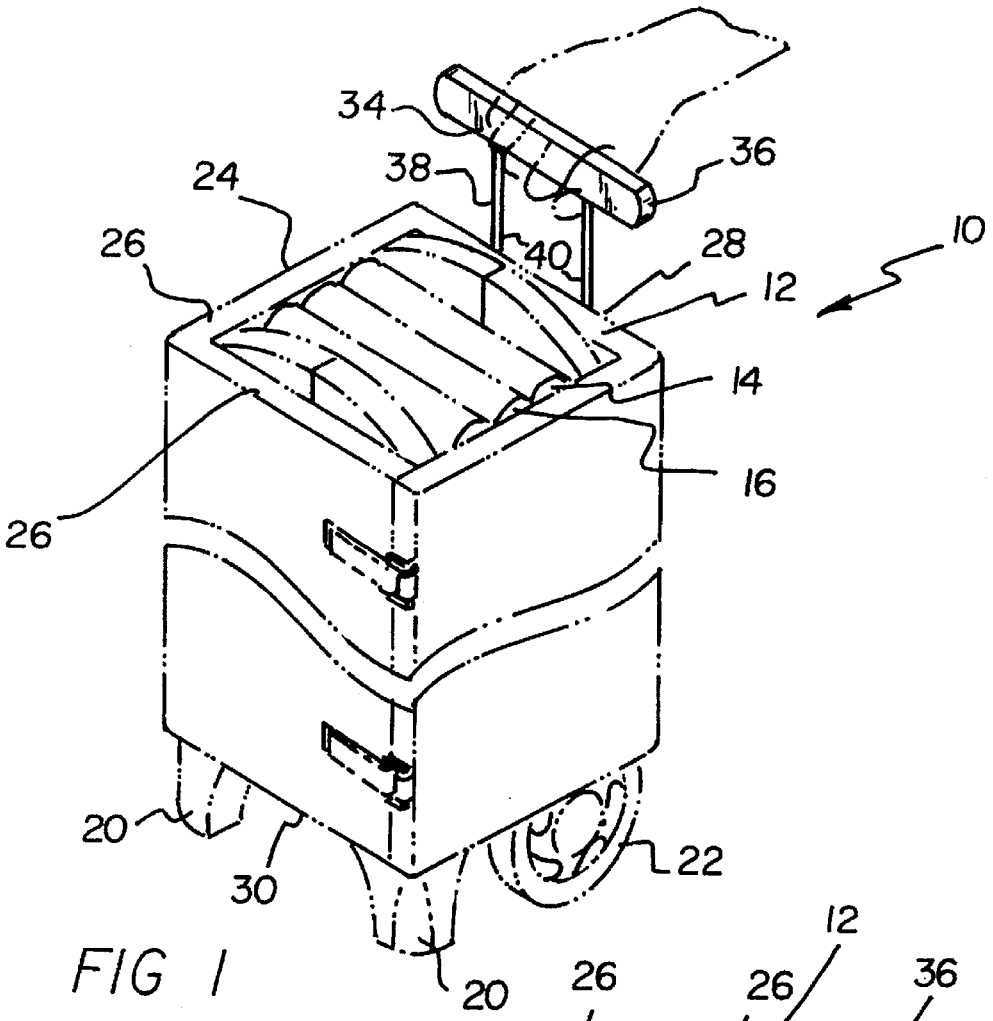
FIG. 1 is a perspective illustration of the preferred embodiment of the playyard system with a handle and wheels constructed in accordance with the principles of the present invention.
Figure 2:
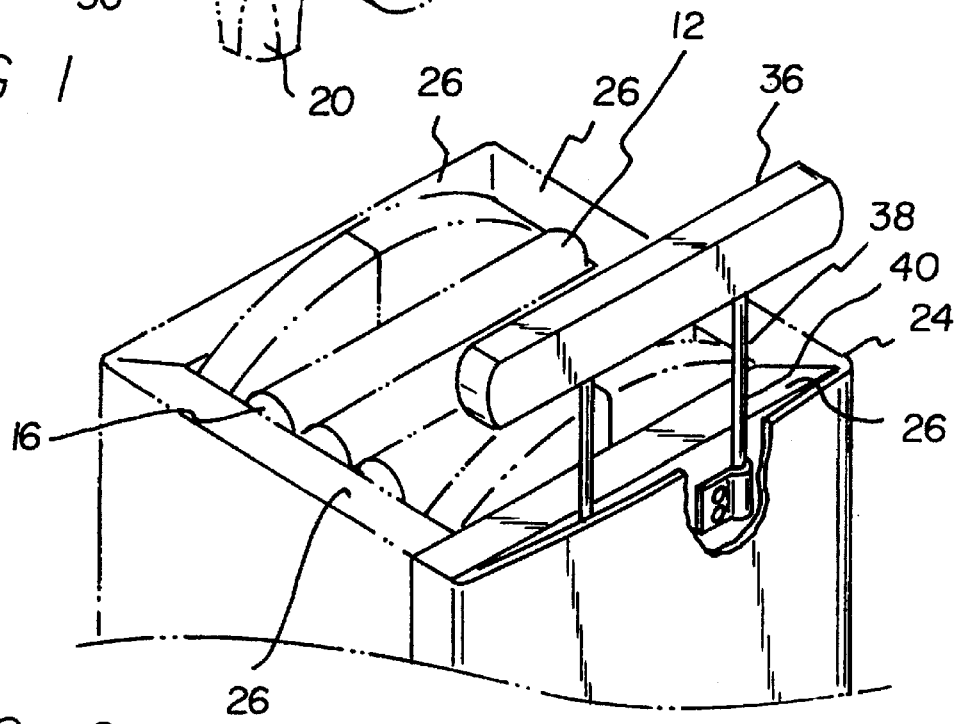
FIG. 2 is an enlarged top elevational view of the device shown in FIG. 1 with parts removed to show certain internal constructions thereof.
Figure 3:
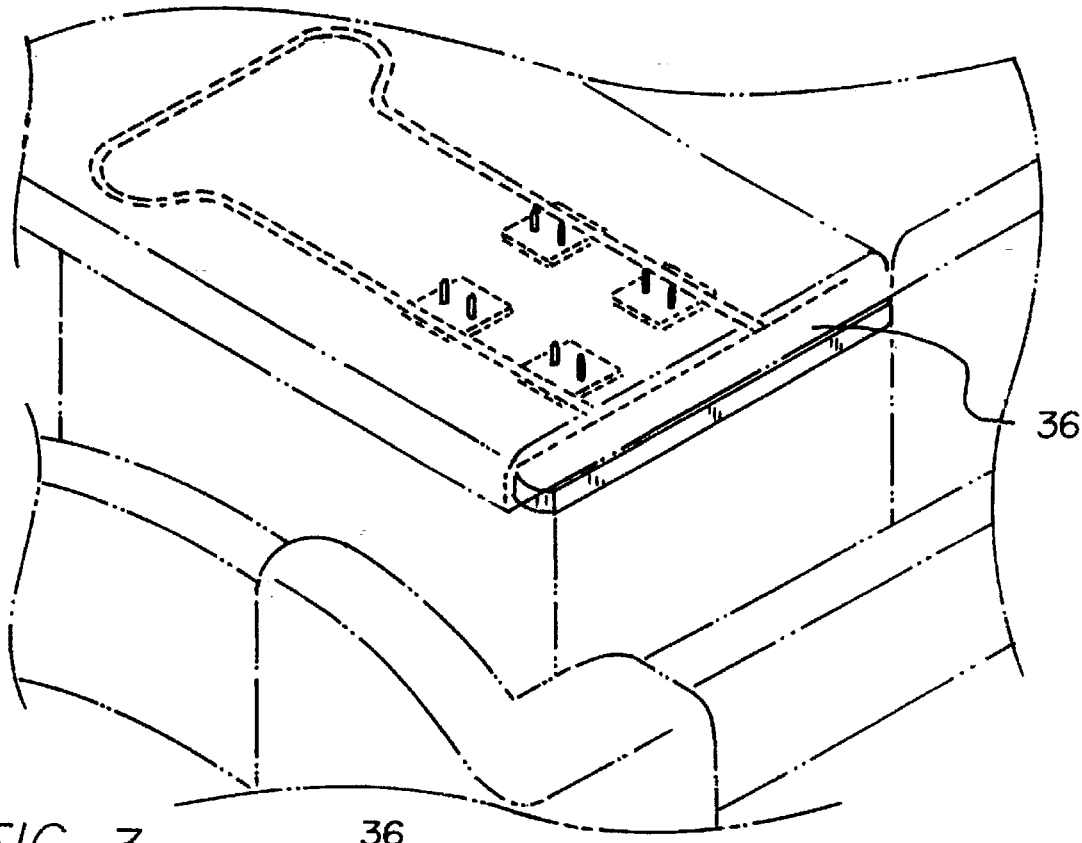
FIG. 3 is an enlarged perspective view of the handle itself and bracket.

With reference now to the drawings, and in particular to FIG. 1 thereof, a new and improved playyard system with a handle and wheels embodying the principles and concepts of the present invention and generally designated by the reference numeral 10 will be described.

More specifically, the present invention may be considered as a system 10 having as its major components a playyard, a separable floor for the playyard, a handle for coupling purposes and a fabric container.

More specifically, the system has as a central component a playyard 12. The playyard has a fabric support 14 for receiving a child. The playyard also has a frame 16 for maintaining the support in a generally rectilinear configuration during operation and use when supporting a child.

The frame is also adapted to collapse to a reduced size in a smaller but still generally rectilinear configuration for transportation and storage. When in the operative or collapsed orientation, the frame is provided with four corners at its upper and lower extents. The corners at the lower extents have depending therefrom two fixed legs 20 at two adjacent corners as well as two rotatable wheels 22 at the other two adjacent corners. Note FIGS. 1 and 4 in particular. Further details of the playyard including its support and frame may be had by reference to U.S. patent application Ser. No. 08/334,841, filed Nov. 4, 1994. The subject matter of such application as well as U.S. Pat. No. 4,985,948 are incorporated herein by reference.

Figure 4:
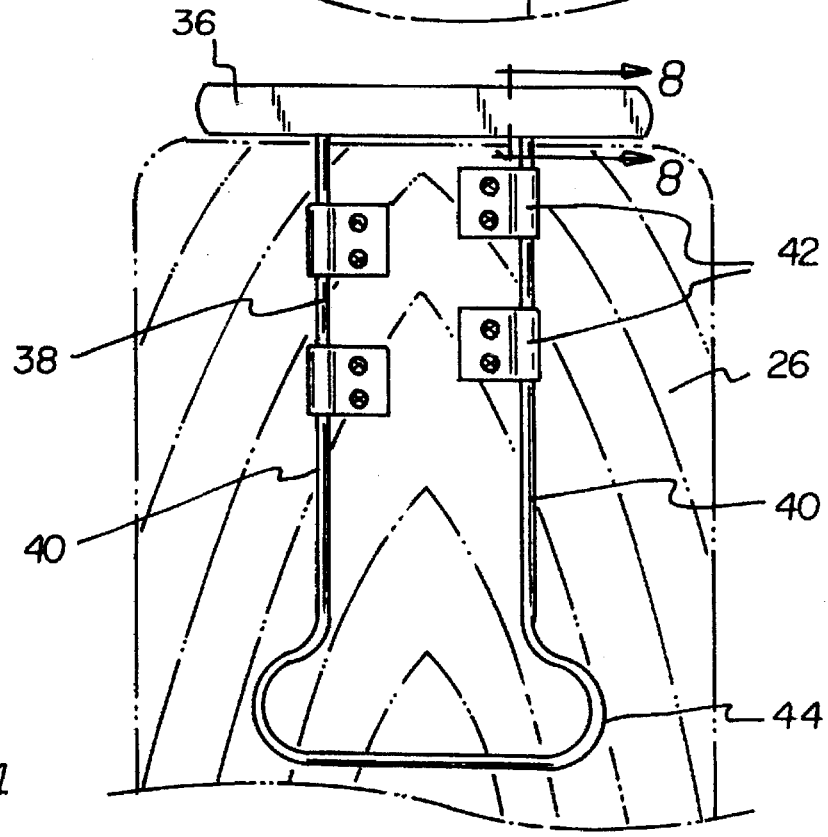
FIG. 4 is a front elevational view of the handle and bracket shown in the prior Figures.
Figure 9:
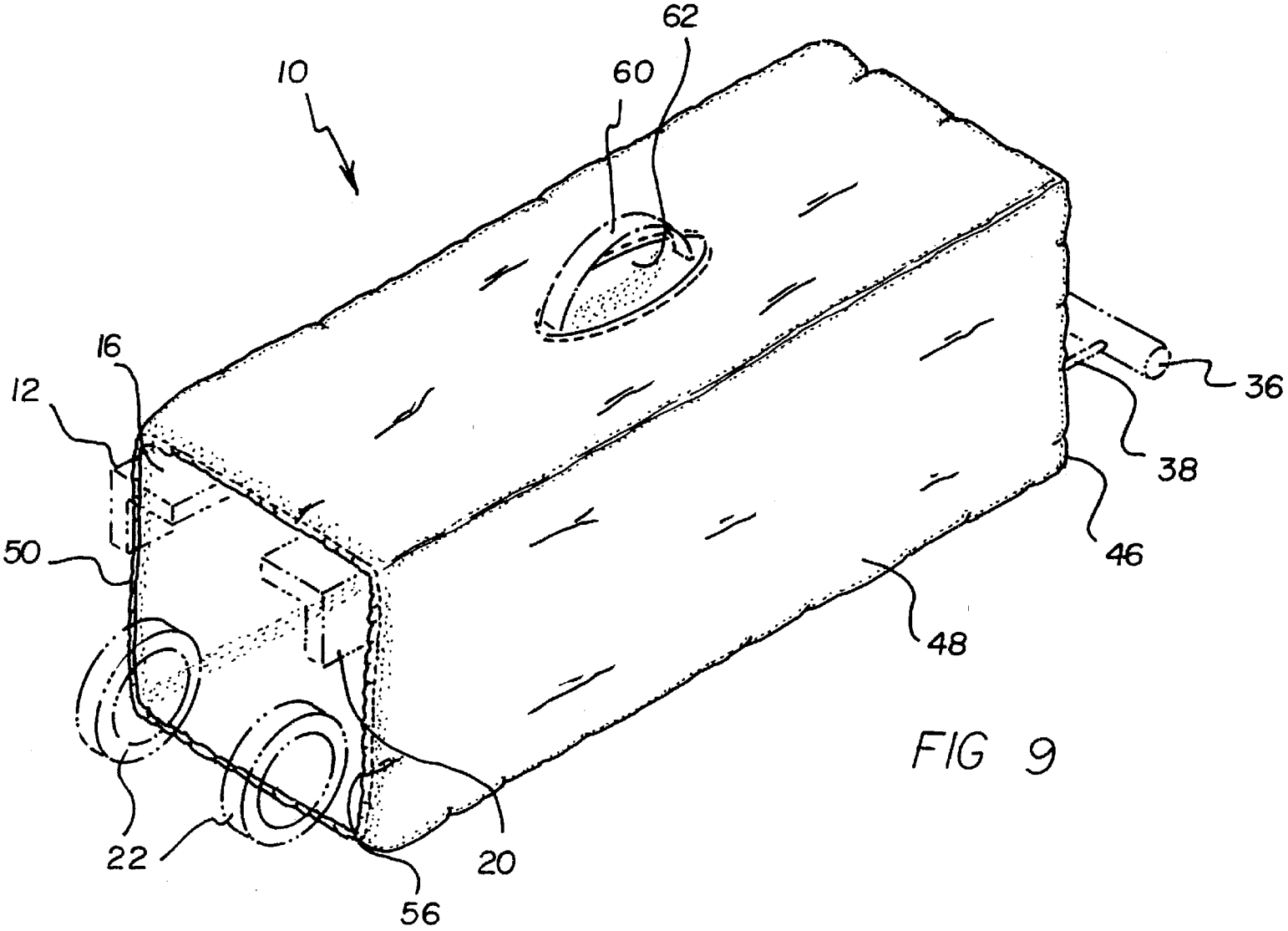
FIG. 9 is a perspective illustration of the device shown in FIG. 1 but with a bag or container thereover.
Figure 10:
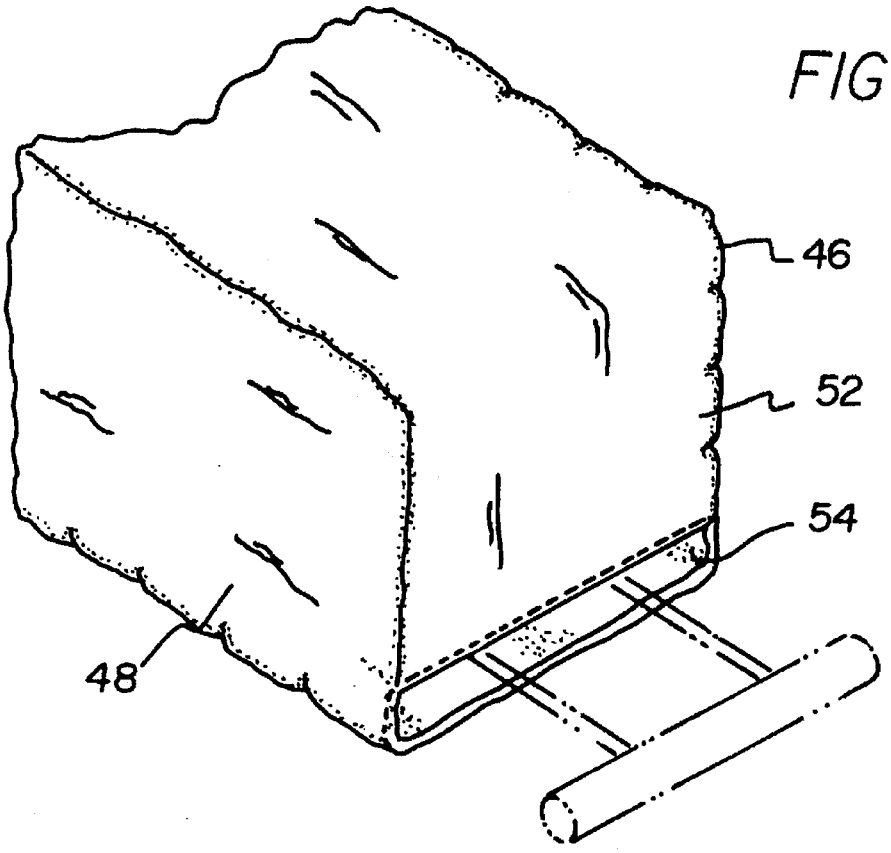
FIG. 10 is an enlarged perspective view of the opposite end of the device shown in FIG. 8.
Figure 11:
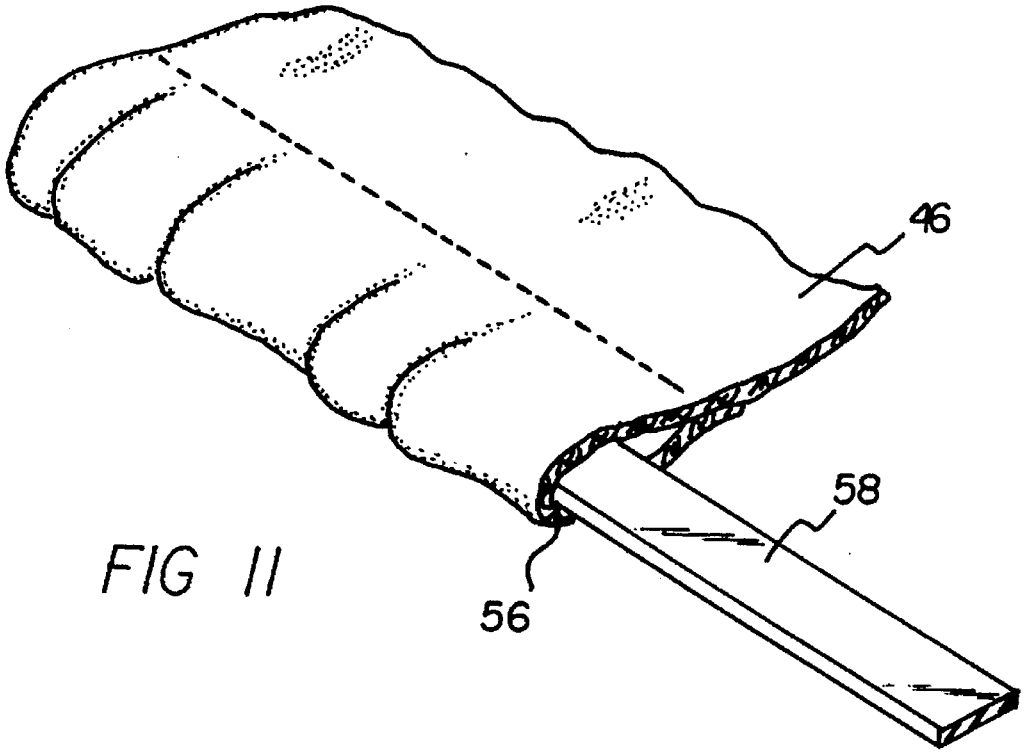
FIG. 11 is a broken away view of the hem of the device shown in FIG. 9.

Formed for use in association with the playyard is a separable floor 24. the floor is formed of four similarly shaped rigid rectangular segments 26. Such segments are positionable on the lower surface of the container during operation and use. The floor is adapted to be removed from the container and placed around the playyard when the playyard is in its collapsed orientation. The floor is then formed into a generally rectangular configuration around the rectilinear collapsed playyard. In such orientation as shown in FIGS. 4, 7 and 8, the playyard and floor have an upper end 28 and a lower end 30. Both such ends are open. The legs and wheels of the frame, however, are adapted to extend beneath the lower end of the floor.

As part of the system, there is then provided a handle 34. The handle is secured to one of the segments of the floor adjacent to the upper end. The handle includes a generally horizontal gripping portion 36 at the upper extent. The handle also includes a generally rigid intermediate wire 38 formed with parallel vertical extents 40 and an enlarged horizontal lower extent 44.

The handle also has associated therewith two pair of apertured brackets 42. Such brackets are secured as by screws to the one lower segment of the floor. Such securement is an exterior face of a segment when placed around a collapsed playyard. The apertures in the brackets receive the vertical extents of the wire and allow such extents of the wire to slide within the brackets. Such sliding is between a lower orientation wherein the handle is in proximity to the floor when in a stowed orientation. Note FIG. 7. The handle can also be raised to a location away from the floor to an elevated orientation for transportation. Note FIGS. 1, 4 and 5. When in such elevated orientation, a user may grasp the elevated handle, pivot the playyard about the wheels, to allow pivoting of the playyard and floor with the raising of the legs. In such orientation the user may then pull the playyard and floor while the wheels rotate.

Lastly provided as a part of the system is a fabric bag or container 46. Such bag or container has a generally rectilinear configuration. It is of such a size as to receive the playyard, floor and handle. The preferred material is a plastic, preferably nylon. The playyard has four rectangular fabric sides 48 with an opened lower end 50. Such opening is for the passage of the legs and wheels depending therefrom. The container also has a closed upper end 52. In the upper end, there is provided a slit 54 adjacent to one edge to overlie the handle. Such slit allows a user to push the handle into the container in the lower orientation or to lift it from the container for an orientation to allow transportation. The lower end is preferably provided with a hem 56 and an elastic band 58 to ensure that the lower end of the container is secured in position beneath the frame during operation and use.

An additional feature of the device is a handle 60 formed on the lower surface of one of the segments of the floor. The handle is preferably of a fabric material and is adapted to be on the central extent of the exterior surface of the floor encompassing the collapsed playyard. In association therewith, an opening 62 is formed in the container in a central extent of one rectangular panel diametrically opposed from the panel adjacent to the slit through which the handle may pass. Such opening and handle allow for the carrying of the collapsed playyard when it is desired not to transport the collapsed playyard by the handle and rotation of the wheels.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved playyard system with a handle and wheels for facilitating transportation of the playyard comprising, in combination:

a playyard having a fabric support for receiving a child, the playyard having a frame to maintain the support in a generally rectilinear configuration for operation and use, the frame also adapted to collapse to a reduced size in a generally rectilinear configuration for transportation and storage, the frame having four corners with fixed legs at two corners and two rotatable wheels at the other corners;

a separable floor formed of four similarly shaped rigid rectangular segments positionable on the lower surface of the container during operation and use, the floor adapted to be removed from the container and placed around the playyard when in a collapsed orientation to form a generally rectilinear configuration with an upper end and a lower end and with the legs and wheels of the frame extending from the lower end;

a handle secured to one of the segments of the floor adjacent to the upper end, the handle including a generally horizontal gripping portion at the upper extent and a generally rigid intermediate wire formed with parallel vertical extents and an enlarged lower extent, the handle also having associated therewith two pair of apertured brackets secured to the floor for allowing for the sliding of the wire within the brackets to lower the handle toward the floor when in the stowed orientation and to raise the handle from the floor when in the elevated orientation for transportation whereby a user may grasp the elevated handle, pivot the playyard, floor and wheels to raise the legs and then pull the playyard and floor while the wheels rotate; and a fabric container having a generally rectilinear configuration for receiving the playyard when collapsed and the floor and the handle with an opened lower end for the passage of the legs and wheels therefrom and with a closed upper end with a slit adjacent one edge overlying the handle for the passage of the handle therethrough.

2. A playyard system with a handle and wheels a playyard having a separable floor with legs and wheels at a lower end, said floor separable from the remainder of the playyard and formed of a plurality of similarly shaped rigid rectangular segments, the floor adapted to be placed around a playyard when collapsed to form a generally rectilinear configuration with an upper end and a lower end; and a handle secured to one of the segments of the floor adjacent to the upper end, the handle including a gripping portion at the upper extent and a generally rigid intermediate wire formed with parallel vertical extents and an enlarged lower extent, the handle also having associated therewith apertured brackets secured to the floor for allowing for the sliding of the wire within the brackets to lower the handle toward the floor when in the stowed orientation and to raise the handle away from the floor when in the elevated orientation for transportation; and a fabric container having a generally rectinilinear configuration for receiving the floor and handle and with an opened lower end and with a closed upper end with a slit adjacent one edge overlying the handle for the passage of the handle therethrough.

3. The apparatus as set forth in claim 2 and further including a hem with an elastic strap at the closed lower end.

4. The apparatus as set forth in claim 2 and further including a handle formed in the central extent of one segment of the floor with an opening in the container for the passage of the handle therethrough.

* * * * *